US011815338B2

(12) United States Patent
Cohen

(10) Patent No.: US 11,815,338 B2
(45) **Date of Patent: *Nov. 14, 2023**

(54) PORTABLE ACTIVE PROTECTION SYSTEM

(71) Applicant: David Cohen, Herzliya (IL)

(72) Inventor: David Cohen, Herzliya (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/679,199

(22) Filed: Feb. 24, 2022

(65) Prior Publication Data

US 2022/0341714 A1 Oct. 27, 2022

Related U.S. Application Data

(60) Continuation of application No. 16/907,398, filed on Jun. 22, 2020, now Pat. No. 11,274,906, which is a division of application No. 16/421,037, filed on May 23, 2019, now Pat. No. 10,690,454, which is a division of application No. 15/736,901, filed as application No. PCT/IL2016/050643 on Jun. 19, 2016, now Pat. No. 10,330,444.

(30) Foreign Application Priority Data

Jun. 18, 2015 (IL) ..... 239522

(51) Int. Cl.
*F41H 11/02* (2006.01)

(52) U.S. Cl.
CPC ..... *F41H 11/02* (2013.01)

(58) Field of Classification Search
CPC ..... F41H 11/02; F41H 11/00; F41H 13/00; F41F 3/04; F41F 5/00
See application file for complete search history.

(56) References Cited

U.S. PATENT DOCUMENTS

| | | | | |
|---|---|---|---|---|
| 4,093,153 | A | 6/1978 | Bardash et al. | |
| 5,198,607 | A | 3/1993 | Livingston et al. | |
| 5,471,213 | A | 11/1995 | Hergesheimer | |
| 6,527,222 | B1 | 3/2003 | Redano | |
| 7,077,049 | B2 | 7/2006 | Shumov et al. | |
| 7,626,536 | B1 | 12/2009 | Rihaczek et al. | |
| 9,250,043 | B1 | 2/2016 | Block et al. | |
| 10,330,444 | B2 * | 6/2019 | Cohen | F41H 11/02 |
| 10,690,454 | B2 * | 6/2020 | Cohen | F41H 11/02 |
| 11,274,906 | B2 * | 3/2022 | Cohen | F41H 11/02 |
| 2002/0149510 | A1 | 10/2002 | Salzeder | |
| 2007/0060045 | A1 | 3/2007 | Prautzsch | |
| 2008/0291075 | A1 | 11/2008 | Rapanotti | |

(Continued)

FOREIGN PATENT DOCUMENTS

| | | |
|---|---|---|
| EP | 2482026 | 8/2012 |
| GB | 2374134 | 10/2002 |
| WO | WO 2016/203481 | 12/2016 |

OTHER PUBLICATIONS

Final Official Action dated Jul. 6, 2021 from the US Patent and Trademark Office Re. U.S. Appl. No. 16/907,398. (9 pages).

(Continued)

*Primary Examiner* — J. Woodrow Eldred

(57) ABSTRACT

The invention relates to a single system that can simultaneously protects a plurality of assets, such as soldiers, vehicles and structures in a given perimeter. The assets are, for example, vehicles and structures that could not otherwise be protected due to tactical and mechanical limitations.

20 Claims, 5 Drawing Sheets

(56) References Cited

U.S. PATENT DOCUMENTS

Figure 1:
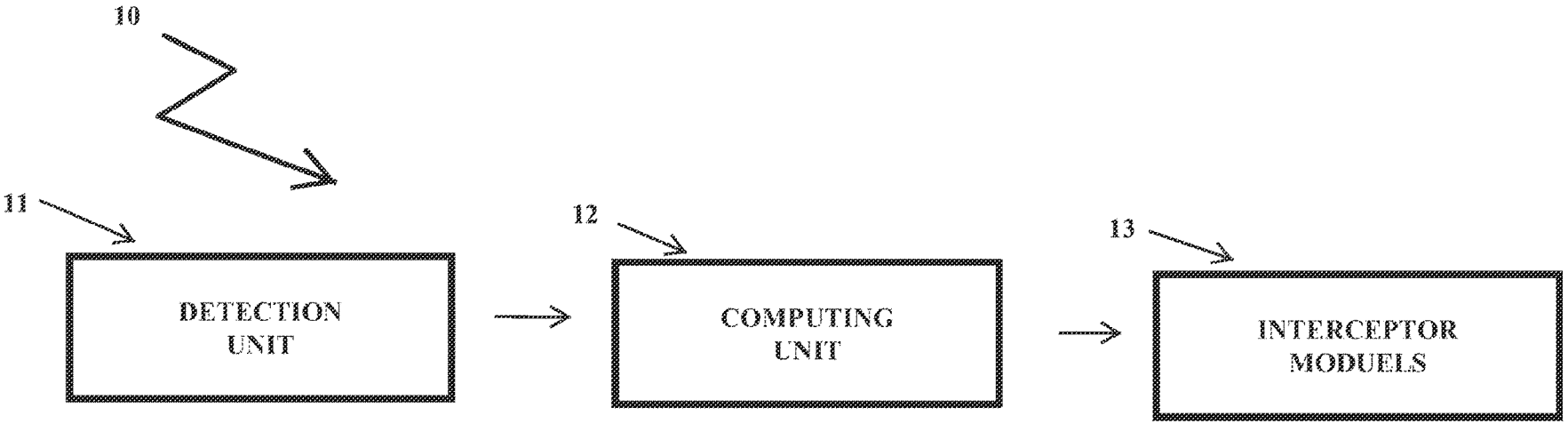

| | | | |
|---|---|---|---|
| 2009/0326735 | A1 | 12/2009 | Wood et al. |
| 2014/0138474 | A1 | 5/2014 | Sharpin et al. |
| 2016/0048129 | A1 | 2/2016 | Kolanek et al. |
| 2016/0253590 | A1 | 9/2016 | Hershey et al. |
| 2018/0172407 | A1 | 6/2018 | Cohen |
| 2019/0346240 | A1 | 11/2019 | Cohen |
| 2020/0318934 | A1 | 10/2020 | Cohen |

OTHER PUBLICATIONS

International Preliminary Report on Patentability dated Dec. 19, 2017 From the International Bureau of WIPO Re. Application No. PCT/IL2016/050643. (7 Pages).
International Search Report and the Written Opinion dated Sep. 13, 2016 From the International Searching Authority Re. Application No. PCT/IL2016/050643. (10 Pages).
Notice of Allowance dated Nov. 12, 2021 from US Patent and Trademark Office Re. U.S. Appl. No. 16/907,398. (3 pages).
Notice of Allowance dated Feb. 19, 2019 From the US Patent and Trademark Office Re. U.S. Appl. No. 10/330,444. (8 Pages).
Notice of Allowance dated Feb. 21, 2020 From the US Patent and Trademark Office Re. U.S. Appl. No. 16/421,037. 8 pages).
Office Action dated Oct. 14, 2020 From the Israel Patent Office Re. Application No. 266759 and Its Translation Into English. (6 Pages).
Office Action dated Aug. 15, 2018 From the Israel Patent Office Re. Application No. 239522. (2 Pages).
Office Action dated Oct. 22, 2017 From the Israel Patent Office Re. Application No. 239522. (2 Pages).
Official Action dated Sep. 18, 2018 From the US Patent and Trademark Office Re. U.S. Appl. No. 10/330,444. (8 Pages).
Official Action dated Oct. 5, 2020 from the US Patent and Trademark Office Re. U.S. Appl. No. 16/907,398. (9 pages).
Supplementary Partial European Search Report and the European Search Opinion dated Jun. 21, 2019 From the European Patent Office Re. Application No. 16811145.8. (9 Pages).
GlobalSecurity "Aegis Weapon System Mk 7", Retrieved from the Internet, 3 pages, Jul. 7, 2011.

* cited by examiner

PORTABLE ACTIVE PROTECTION SYSTEM

RELATED APPLICATION/S

This application is a continuation of U.S. patent application Ser. No. 16/907,398, filed on Jun. 22, 2020, which is a division of U.S. patent application Ser. No. 16/421,037, filed on May 23, 2019, now U.S. Pat. No. 10,690,454, which is a division of U.S. patent application Ser. No. 15/736,901, filed Dec. 15, 2017, now U.S. Pat. No. 10,330,444, which is a National Phase of PCT Patent Application No. PCT/IL2016/050643 having International Filing Date of Jun. 19, 2016, which claims benefit of priority from Foreign Patent Application IL 239522 (Israel), filed Jun. 18, 2015. The contents of the above applications are all incorporated by reference as if fully set forth herein in their entirety.

FIELD AND BACKGROUND OF THE INVENTION

The field of the invention relates in general to portable active protection systems for protecting assets, including soldiers, vehicles and structures from incoming missiles and rockets. More specifically, the invention relates to an active protection system which may be handheld.

Known in the art are variety of systems that are designed to intercept and destroy incoming missiles and rockets with a shotgun-like blast that ejects a plurality of particles towards the incoming object with the intent of jeopardizing its structure integrity to the point of rendering it useless or impairing its functionality. For example, a system known in the art by its commercial name "Trophy", is a military system for active protection for vehicles, such as light and heavy armored fighting vehicles and vehicles in general. Developed by Rafael Advanced Defense Systems and Israel Aircraft Industries' Elta Group, the system intercepts and destroys incoming missiles and rockets with the abovementioned shotgun-like blast, as to supplement the fighting vehicles' armor.

The above prior art systems are designed to protect the vehicle that they are placed on, and as the systems are highly expensive, their deployment is limited to a select few only. Furthermore, as the system is deployed on vehicles that are already fitted with a variety of other systems such as radar, electro-optics, communication, and weapons systems, the deployment on the vehicles poses a great engineering challenge, as well as a tactical handicap, as the systems activation in battle conditions is limited by the need to avoid damage to all other existing systems.

SUMMARY OF THE INVENTION

It is an object of the invention to provide a single system that can simultaneously protect a plurality of assets, such as soldiers, vehicles and structures in a given perimeter.

It is another object of the invention to significantly reduce the costs involved in protecting a plurality of vehicles.

It is still another object of the invention to enable protection of assets, such as vehicles and structures that could not otherwise be protected due to tactical and mechanical limitations as mentioned above.

It is still another object of the invention to reduce the likelihood of collateral damage of charge activation to the carrying platform.

It is still another object of the invention to increase the likelihood of a successful interception, relative to systems of the prior art, especially when a large number of missiles and rockets are fired at a designated spot or a perimeter, either simultaneously or consecutively.

According to one aspect of the present embodiments, there is provided an interception device for protecting assets from incoming missiles, which device is autonomous of the asset being protected.

According to a further aspect of the present embodiments, there is provided a vehicular interception device for protecting assets from incoming missiles, the vehicular interception device comprising autonomous positioning for positioning said vehicle in relation to said assets and an expected threat.

According to a yet further aspect of the present embodiments, there is provided an interception device for protecting assets from incoming missiles, which device is manportable for positioning to protect a perimeter.

An embodiment may be configured to track the location of at least one asset and to intercept an incoming missile threatening said asset.

An embodiment may be configured to track the locations of a plurality of assets as said assets move and to intercept an incoming missile threatening at least one of said plurality of assets.

An embodiment may be configured to track the locations of a plurality of assets as said assets move, to move to a position to defend said assets against threats and to intercept an incoming missile threatening any one of said plurality of assets.

An embodiment may comprise at lease one detection unit configured to detect incoming threats and a plurality of reaction units configured to intercept said incoming threats, and a control unit configured to select a best located reaction unit to react to a given incoming threat.

An embodiment may comprise a plurality of control units and a plurality of reaction units configured to intercept said incoming threats, said control units configured to communicate with each other to select a best located reaction unit to react to a given incoming threat.

An embodiment may comprise at lease one radar unit configured to detect incoming threats, said at least one radar unit associated with one of said control units.

An embodiment may relate to a system for protecting mobile or stationary objects from incoming missiles or rockets, which comprises: (a) at least one detection unit for detecting an incoming object; (b) at least one computing unit for: (i) receiving information relating to the detection of said incoming object, and location information from said plurality of assets (ii) calculating the trajectory of said incoming object, and (iii) analyzing said information to timely activate one or more of interceptor modules to at least damage said incoming object. The assets may be provided respectively with a positioning unit and a communication unit that are used for determining and transmitting, respectively, position data of each of the assets to ensure they are protected.

BRIEF DESCRIPTION OF THE SEVERAL VIEWS OF THE DRAWING(S)

Figure 2A:
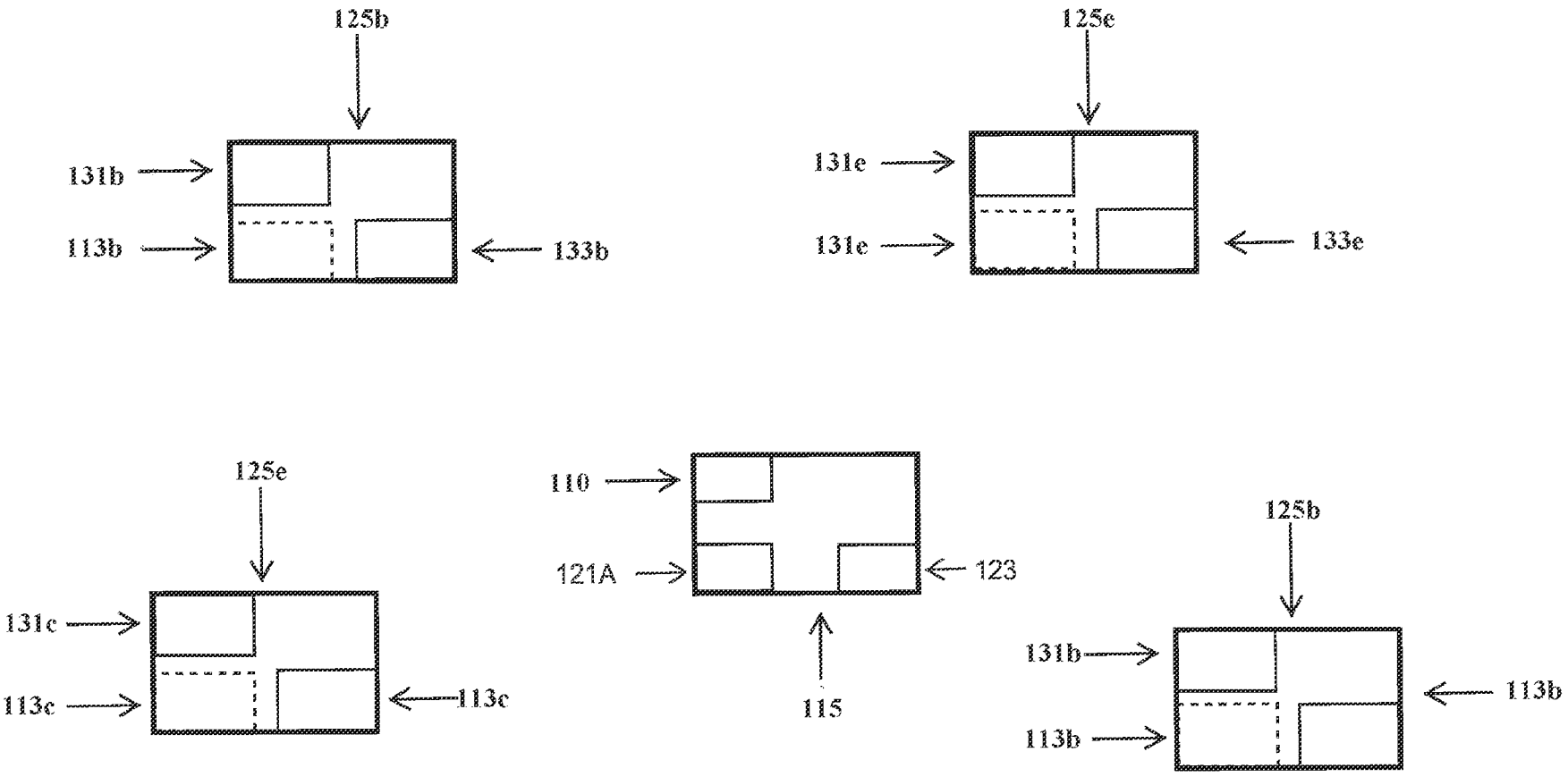
Figure 2B:
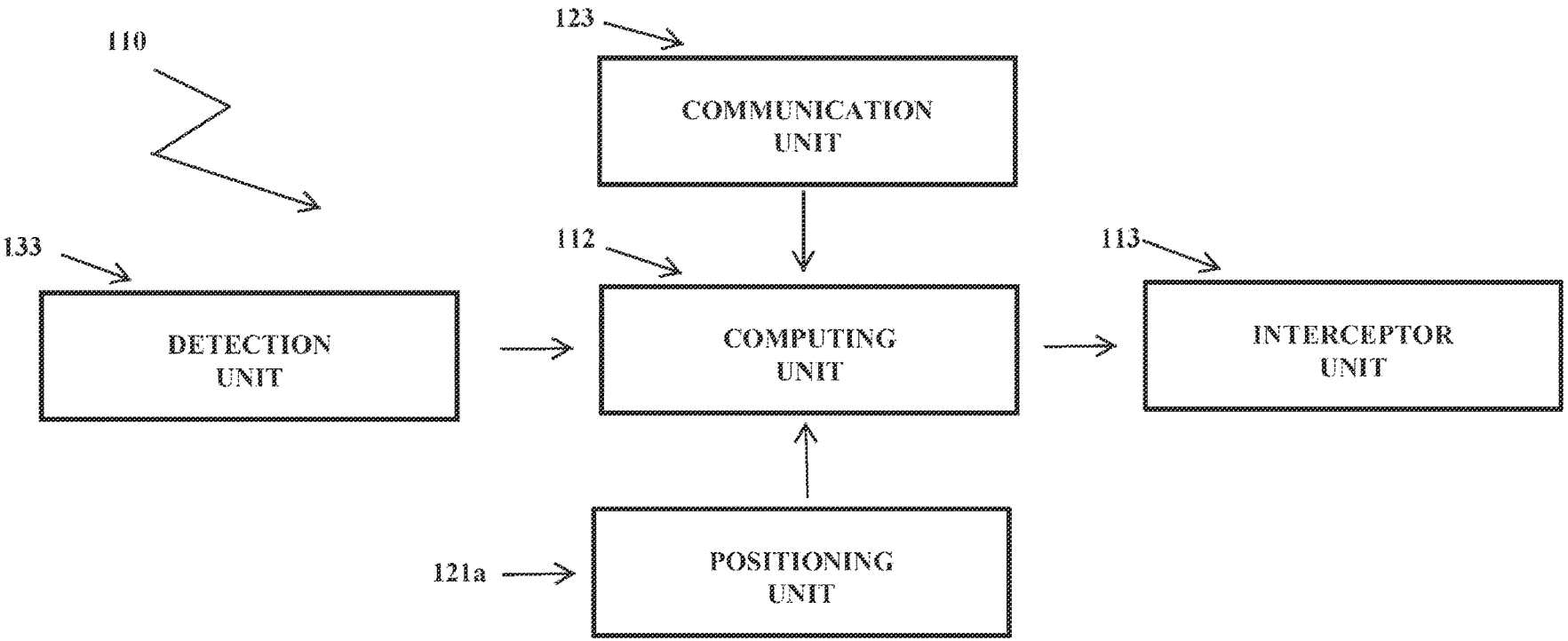
Figure 3:
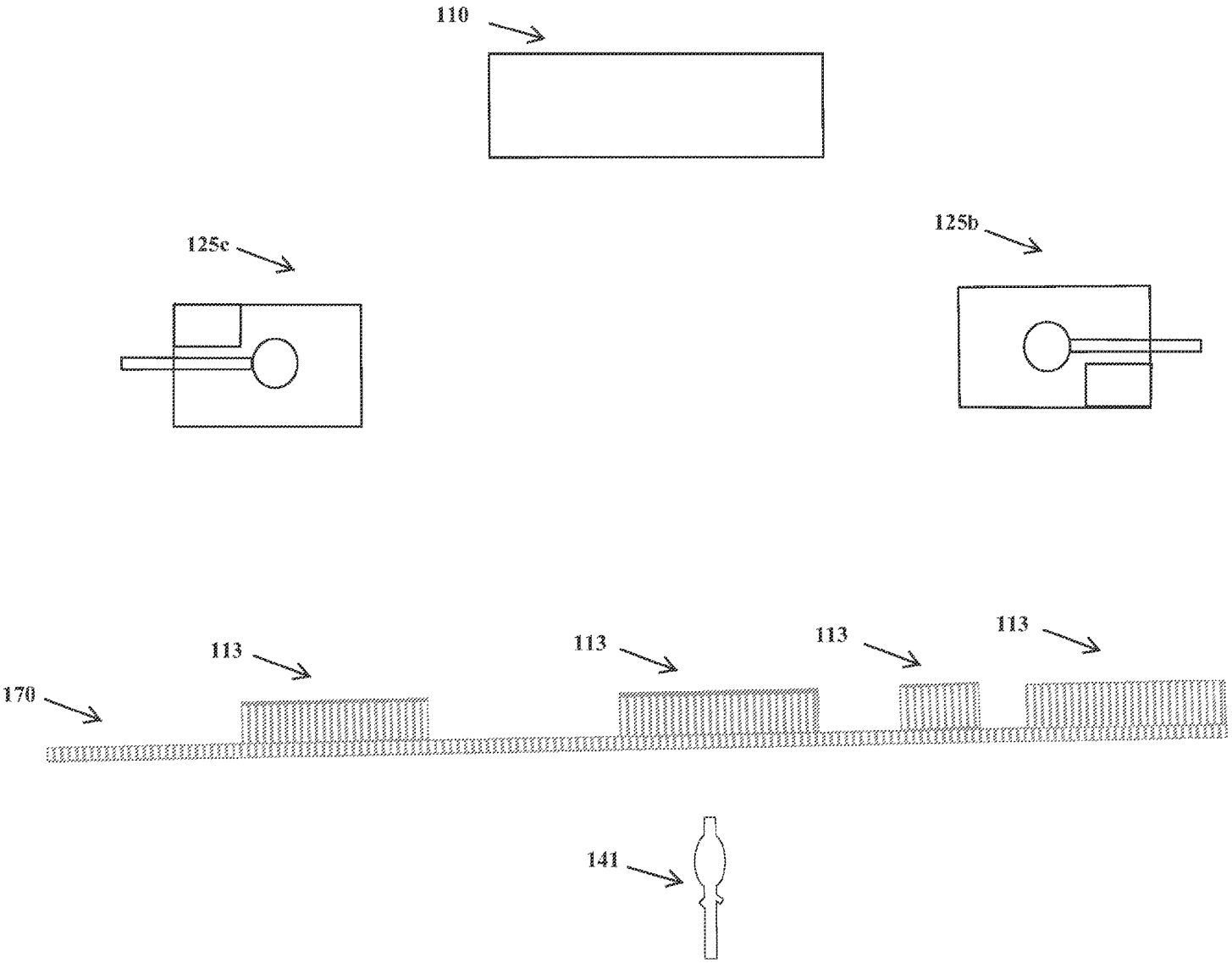

In the drawings:

FIG. 1 shows in block diagram form the structure of a typical prior art protection unit;

FIG. 2*a* shows how a central protection unit according to the invention may be used to protect plurality of assets in a perimeter;

FIG. 2*b* shows in block diagram form the structure of one embodiment of the system of the invention;

FIG. 3 shows another embodiment of the system of the invention; and

Figure 4B:
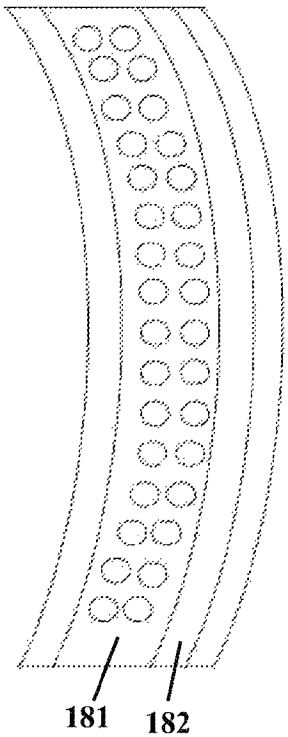
Figure 4A:
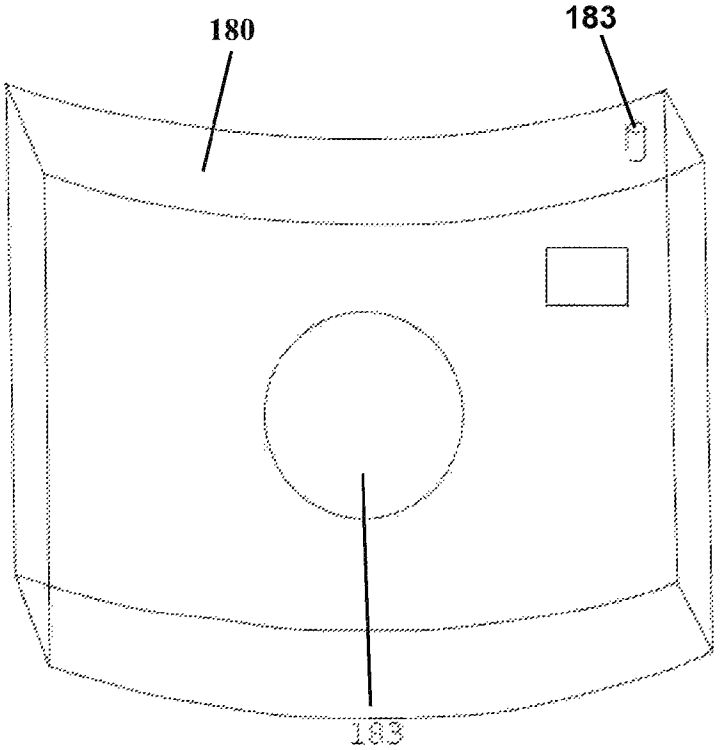
Figure 4C:
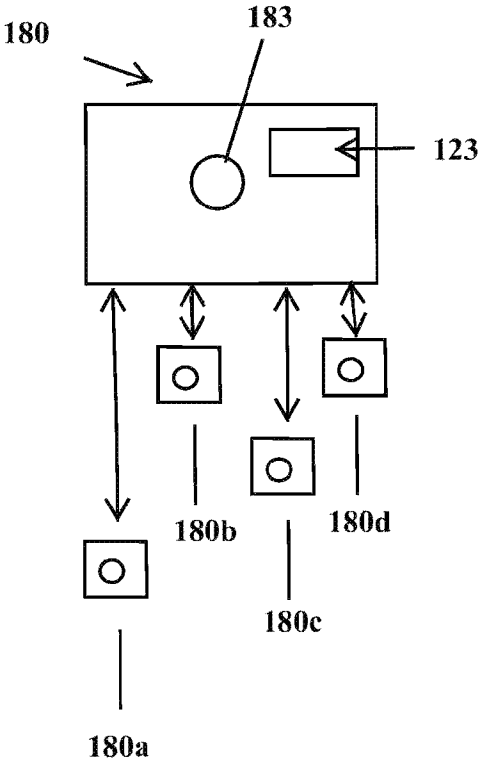

FIGS. 4*a*, 4*b*, and 4*c* show respectively still another embodiment of the invention, where one or more of portable protection units are used.

DESCRIPTION OF SPECIFIC EMBODIMENTS OF THE INVENTION

As noted, active protection systems utilizing the concept embodied by the Trophy system and the like are designed to protect the vehicle that they are mounted on. The radar of said systems (may it be an RF, optical or the like) is designed to scan the theater in which it operates, as to detect an incoming object, that is likely to hit the vehicle on which the radar and system are deployed. When the likelihood of a hit is established, the system is operated so as to intercept the incoming object as set forth. If, however, the system determines that the incoming object will not hit the vehicle or structure on which it is mounted, the system is not activated, even though the inbound object may eventually hit another friendly asset.

As will be shown, the present invention may drastically increase the survivability of friendly assets in the battlefield, even when the assets are not equipped with a system-type as described above.

The present invention provides a method and system for protecting multiple assets, such as vehicles or structures, even when the assets themselves are not fitted with all or any of the system's components, i.e., the radar or the interceptors.

FIG. 1 shows a basic structure of a typical prior art active protection system 10 (such as a Trophy-type system). The system comprises a detection unit 11 (such as electro-optic or RF radar), a computing unit 12, and one or more interception modules 13. Typically, the detection unit 11 continuously scans the perimeter around the vehicle. The scan readings are analyzed by the computing unit 12, so as to detect an incoming object that may pose a threat to the protected vehicle. Upon such detection, the computing unit 12 may activate the one or more interceptor modules in a manner that will assure the highest chance of intercepting the incoming object. However, if the computing unit 12 determines that the incoming object is not likely to hit the vehicle, it will avoid activation.

FIGS. 2*a* and 2*b* illustrate a deployment of the system of the present invention in battle conditions, according to a first embodiment. An active protection system 110 is mounted on a Main Protection Vehicle (MPV) 115. The structure of system 110 (shown in FIG. 2*b*) is in fact similar to the structure of the system 10 of FIG. 1. In addition, MPV 115 comprises a positioning unit (such as GPS) 121 *a* that determines its own position. In addition, MPV 115 comprises a communication unit (receiver or transceiver) 123. In addition, each of the other friendly assets 125 *b*-125 *e* in the perimeter of the MPV 115 comprises its own positioning unit 131 *b*-131 *e*, and its own communication unit 133 *b*-133 *e*, respectively.

Each of the assets 125 *b*-125 *e* continuously transmits its own position via its own communication unit 133 *a*-133 *d*, respectively. Optionally, each of the assets might transmit additional asset data such as a unique ID, as well as/or its functionality, number of occupants, urgency and/or status of mission, acceleration readings, and/or any type of data that can be collected via sensors array, etc. The MPV 115 receives the transmitted locations, respectively from all of the assets 125, and optionally any additional asset data. The received information is analyzed by the computing unit 112 (shown in FIG. 2*b*) at the MPV 115, to determine which of the assets can be protected by the MPV 115. This determination process is based on the capability of the MPV to protect each of the assets, by analyzing the MPV's interceptor range, terrain (for example, by analyzing known Digital Elevation Maps), etc. Moreover, the received assets data can be taken into account to establish protection priorities for each of the assets 125. As the MPV's protected assets list is established, the MPV 115 may transmit its own list of protected assets (as well as any additional data related to the assets) to one or more of similar MPV's 115 in the battlefield. As other MPV's computing units 112 receive said list of protected assets (via their own communication unit 123), they can determine their own list of protected assets, respectively, taking into account their ability to protect assets in an optimal way. Furthermore, an MPV might take into account the amount of interceptor modules available to it, as well as any other relevant data.

As an MPV 115 establishes its own list of protected assets in the perimeter, inbound missiles that poses a threat to said list of protected assets may be intercepted by said MPV by initiation of its one or more interception modules 113.

In another embodiment, each of the various assets 125 might be equipped with its own interceptor modules 113 *b*-113 *e*, respectively, however without a detection unit (such as detection unit 111 of FIG. 2*b*), while in this case the MPV itself may be in charge of activating the interceptor modules 113 of each of the protected assets 125, accordingly.

It should be noted that the computing unit 112 of the MPV 115 may calculate a geographic location which is optimal for it to protect the assets existing in its own list. Once this geographic location is established, the MPV moves to this optimal calculated location. The MPV may further receive via its communication unit 123 real time intelligence driven data by which it may position or reposition itself, or it may amend its assets list. In still another alternative, the one or more MPVs 115 positions, and their asset lists, respectively, may be transmitted to a command and control center (not shown) as to allow a commanding body to assign each of a plurality of MPVs to secure a geographic perimeter, respectively, regardless of their own-calculated assets lists.

In still another embodiment, the MPV 115 may be of robotic type. In such a case, the MPV may use robotic driving capabilities known in the art to position itself within a military formation, such as a column of vehicles, so as to provide protection to the formation, which protection is updated as it moves.

In still another embodiment an MPV may be guided to a position either manually or robotically. On the MPV there are only interceptor modules 113 that are remotely activated by a remote detection unit 111 and a related computing unit 112 so as to secure friendly assets in a perimeter.

In still another embodiment shown in FIG. 3, the protection unit 110 is stationary. In some embodiments the unit may be manually portable and in other embodiments may be provided by or mounted on or integrated with a vehicle. The protection unit scans via its detection unit 111 (not shown) a given terrain as to detect inbound missiles 141 aimed at friendly assets 125. The friendly assets may be moving vehicles or stationary structures or soldiers or formations of soldiers or vehicles. Stationary interceptors 113 may be positioned for example at predetermined geographical locations (such as next to a border 170) so as to achieve in a very inexpensive way a very large scale perimeter protection of friendly assets. Likewise portable units may be positioned by soldiers engaged in operations to protect themselves from missile fire. Interceptors 113 may be positioned in large clusters so as to defeat an attempt to pierce the perimeter protection (such as border 170) by firing a large number of missiles to an exact point, the missiles being intended to exhaust the interceptors supply. In a preferred embodiment, large charges, for example, 25 Kg of composite B and 20 Kg of rigid fragments, such as metal balls, may be positioned in known positions, wherein the charges may be angled towards the direction from which the inbound missile is expected to come, and then the system may activate them as to destroy inbound missiles that are shot from hostile locations, for example, across the border line 170. The exact coordinates of each of the charge interceptors (charges) 113 may be verified manually, for example, by use of GPS or surveying equipment, wherein the coordinates are fed into the computing unit 112 (not shown) of protecting system 110 as to enable it to timely activate one or more of the interceptors 113 to detonate appropriate charges.

In still another embodiment, the location of the assets 125 may be detected using a detection unit such as radar, camera, etc., preferably concurrently the asset location data is conveyed to the computing unit 112 (not shown) within the respective protecting unit 110. The radar may be mounted on an MPV 115, or may be static or may be man-portable.

In still another embodiment shown in FIGS. 4*a*, 4*b*, and 4*c*, a crucial battle zone problem is solved. In numerous events, soldiers in close quarter combat end up barricading themselves in a building. In events graphically depicted in the movie "Black Hawk Down", insurgents used RPG7 shoulder-mounted rockets to attack barricaded soldiers as the soldiers were unable to evacuate the compound in which they were besieged. So as to secure a perimeter against shoulder mounted rockets, a portable interception unit 180 is provided to defeat incoming missiles. As shown in FIG. 4*b* (showing the cross section of the portable interception unit 180), the charge within the interception unit 180 is comprised of rigid particles 181 (such as ball bearings), high explosive 182, and a detonation circuit (not shown). The charge is associated with a small short range detection unit 183 (such as optical, and/or electromagnetic, RF radar, etc.), which may be housed within the casing of portable unit 180, or external thereof—as shown in FIG. 4*c* which shows an interception device 180 which operates centrally to control one or more of units 180 *a*-180 *d*. Upon detection of an incoming missile by a detection unit 183, a blast sequence may be initiated, ejecting the rigid particles towards the incoming missile to render it ineffective. As shown in FIG. 4*c*, a single interception device 180 may control and activate a plurality of portable interceptors 180*a-d*, via a physical line or wireless (using communication units 123). In the case where a plurality of portable interceptor units are associated with a single interception device 180 (as shown in FIG. 4*c*), the interceptor units may be scattered at a distance from one another.

As activation of charges may be expected to coincide with an exact location of a charge in relation to an incoming missile trajectory, the portable interceptors 180 are equipped with a positioning unit 121, enabling the computing unit within the portable unit 180 to timely activate the blast sequence by the interceptors.

The different units 180, 180 *a*, 180 *b* etc may communicate with each other to ensure that only the most appropriately placed unit reacts to any given incoming threat.

In an embodiment, the MPV 115 may be sent ahead of a tank or other asset and provide a buffer zone or safety zone in which incoming missiles are destroyed ahead of the assets. Such a buffer zone may be useful in the case of soft assets such as soldiers being located in the vicinity of hard assets such as tanks.

The present embodiments may be able to provide protection at angles which the geometry of a tank makes difficult to protect.

The MPV may be a vehicle dedicated to missile interception and may thus contain more interception capacity than can be carried on the asset itself. Furthermore detonation of the interception device may be distanced from the asset itself, thus avoiding damage to the asset. In this way, violent interception devices may be used to protect soft assets such as soldiers. The interception devices may be any kind of device and independent of the interception system.

It is the intent of the Applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A threat interception system for protecting mobile assets from incoming missiles, the system comprising:

a vehicle and a first vehicle-carried interception device located on said vehicle; and an autonomous positioning controller for positioning of said vehicle-carried interception device in relation to said mobile assets and an expected threat, the autonomous positioning controller further configured to track the locations of a plurality of said mobile assets as said assets move, and to control said vehicle to move to a position to defend said mobile assets against threats, said position being selected based on said tracking, and to control said first vehicle-carried interception device to intercept a detected incoming threat threatening any one of said plurality of mobile assets.

2. The threat system of claim 1 wherein said autonomous positioning controller is mobile.

3. The threat interception system of claim 1, comprising at least one further vehicle carried interception device and wherein said first and said at least one other vehicle-carried interception devices are networked together.

4. The threat interception system of claim 2, wherein said vehicle is a robotic vehicle.

5. The threat interception system of claim 4, configured to intercept an incoming threat threatening any one of said plurality of assets.

6. The threat interception system of claim 3, wherein said autonomous positioning controller is configured to select one of said vehicle-carried interception devices to react to a given one of said incoming threats.

7. The threat interception system of claim 2, further comprising:

a detection unit associated with said autonomous positioning controller, said detection unit configured to detect incoming threats; and a control unit configured to select a best located vehicle-carried interception device to react to a given incoming threat.

8. The threat interception system of claim 7, comprising a plurality of said control unit, said control units configured to communicate with each other to select a best located reaction unit to react to a given incoming threat.

9. The threat interception system of claim 8, wherein said detection unit comprises radar.

10. A threat interception system for protecting mobile assets within a perimeter from incoming missiles, the system comprising:

a plurality of interception devices disposed within said perimeter;

a detection unit configured to detect incoming threats to assets within said perimeter; and a control unit configured to receive said detections of incoming threats from said detection unit and to select a best located one of said plurality of interception devices to react to a given incoming threat.

11. The threat interception system of claim 10, wherein at least some of said plurality of interception devices are mobile, said control unit further configured to position said interception device in relation to said mobile assets and an expected threat.

12. The threat interception system of claim 11, wherein said control unit is further configured to track the locations of a plurality of said mobile assets as said assets move, and to control said mobile interception devices to move to a position to defend said mobile assets against threats, said position being selected based on said tracking.

13. The threat interception system of claim 10, wherein said detection unit is combined with one of said interception devices.

14. The threat interception system of claim 13, wherein said detection unit is internal to said one of said interception devices.

15. The threat interception system of claim 14, wherein said detection unit is an external unit.

16. A protective array for protecting land-based assets from incoming threats, which protective devices are portable over ground for positioning to define a protective perimeter around said assets, the protective devices comprising at least one asset tracking device configured to track the locations of a plurality of assets as said assets move, at least one threat detection device to detect respective incoming threats and at least one interception device to intercept an incoming threat detected by said threat detection device and determined to threaten any one of said plurality of assets, wherein the protective devices are networked together and configured to select one of said protective devices to react to a given incoming threat.

17. The protective array of claim 16, wherein said networked protective devices are configured together to select a one of said protective devices having a strongest detection of said respective incoming threat.

18. The protective array of claim 16, wherein said networked protective devices are mounted on robotic vehicles.

19. The protective array of claim 18, wherein said networked protective devices are configured to move in accordance with said tracking of said assets.

20. The protective array of claim 16, wherein at least one of said networked protective devices is man-portable.

* * * * *